US005432967A

United States Patent [19]

Raftery

[11] Patent Number: 5,432,967

[45] Date of Patent: Jul. 18, 1995

[54] MULTIPLE POSITION SUPPORT CUSHION

[75] Inventor: William B. Raftery, Canton, Ohio

[73] Assignee: Raftery Design, Inc., Canton, Ohio

[21] Appl. No.: 263,363

[22] Filed: Jun. 20, 1994

[51] Int. Cl.[6] ..... A47C 20/02; A47G 9/00

[52] U.S. Cl. ..... 5/633; 5/652; 5/644; D6/601

[58] Field of Search ..... 5/633, 630, 634, 644, 5/419, 652, 657; 297/230.1, 452.17; D6/601, 604

[56] References Cited

U.S. PATENT DOCUMENTS

| | | | |
|---|---|---|---|
| D. 259,381 | 6/1981 | Smith | D6/601 |
| 2,612,645 | 10/1952 | Boland | 5/633 |
| 3,003,815 | 10/1961 | Zinn | 5/633 |
| 3,348,880 | 10/1967 | Swann | 297/230.1 |
| 3,555,582 | 1/1971 | Radford | 5/632 |
| 3,680,917 | 8/1972 | Harris | 5/633 |
| 4,635,306 | 1/1987 | Willey | 5/633 |
| 4,987,625 | 1/1991 | Edelson | 5/657 |
| 5,115,529 | 5/1992 | White | 5/633 |

*Primary Examiner*—Alexander Grosz
*Attorney, Agent, or Firm*—Michael Sand Co.

[57] ABSTRACT

A multiple position, resilient support cushion, has a generally triangular shape and may be used in any of three positions to create a lying, sitting and in-between resting position, and which provides support for the head and body of the user when in any of these positions. The cushion has first, second and third support surfaces extending between parallel side surfaces. The first and second surfaces have generally continuous configurations, and the third surface has a multiple contour or stepped configuration. The third surface has a pair of generally equal length portions joined together by an inwardly extending intermediate portion which forms an intermediate corner. The second and third surfaces form a flexible triangular-shaped upper portion at their junction when the cushion is supported on its first surface, which upper portion positions the weight of the body over the second surface of the cushion rather than against it. The corner and intermediate portion of the stepped surface supports the neck of a user and the two adjacent surface portions support the head and back of the user when the cushion is supported on the second surface. The body may be formed of a resilient foam material or of an air inflatable bladder.

16 Claims, 3 Drawing Sheets

MULTIPLE POSITION SUPPORT CUSHION

BACKGROUND OF THE INVENTION

1. Technical Field

The invention relates to a type of furniture, and specifically, to a support cushion for use on floor surfaces, in bed, or on the ground to provide support for the body of the user in either sitting or lying positions. More particularly, the invention relates to a triangular-shaped resilient body for supporting the body, and in particular, the head, back and neck of the user in various positions while relaxing.

2. Background Information

Many children and adults spend a considerable amount of time in supine, sitting and intermediate positions while watching television, playing video games, reading, sun bathing, writing and the like. Depending upon the particular position assumed by the individual, undesirable pressure can be placed on various portions of the individual's body. For example, many people when sitting on the floor or ground, assume a position with their legs crossed and their elbows resting on their legs in order to assist in supporting their upper body. This positions the curvature of the spine into a condition called "kyphosis" in which the pelvis is rotated backwards and the spine is curved in a forward manner. This position puts stress on the discs between the vertebrae in an uneven manner, most noticeably in the lumbar area of the back. This may result in damage to the discs over time, and results in restricted pulmonary and circulatory functions as well.

Devices have been made to provide some type of support, and in particular, a cushion for use by individuals when seated on a floor for viewing TV, reading, or the like. One such device is shown in U.S. Pat. No. 4,987,625. This device consists of a plurality of resilient cushions which are flexible attached to each other to form a collapsible unitary structure which may be adjusted to provide head and body support for persons working or resting in prone, supine and other bodily attitudes. Although the support apparatus of this patent may provide the desired functions and results, it is a relatively large and bulky apparatus, and may be too expensive for many people to purchase for themselves or for their children.

Another simpler prior art support cushion is shown in U.S. Pat. No. 4,635,306. This cushion consists of a pair of specially designed and angularly shaped cushions which can be placed together in various configurations to provide various support angles for a body lying or seated thereagainst. Again, this structure requires at least two cushions, thereby increasing its bulkiness and cost.

Therefore, the need exists for an improved support cushion which is of a relatively simple and inexpensive construction, enabling it to be easily afforded by most individuals, yet which provides adequate support for the user, whether the user is lying down or seated thereagainst, or in other in-between resting positions.

SUMMARY OF THE INVENTION

Objectives of the invention include providing a singular resilient cushion that may be easily positioned in any one of three positions, to provide support for the head, neck, back and other portions of the body of a user, in either sitting, lying or in-between resting positions, to provide adequate support for and to accommodate the user to reduce stress on various parts of the user's body, and in particular, the spine.

A still further objective of the invention is to provide a support cushion which may be formed of a resilient foam material having a cloth or fabric cover thereon, or which may be formed of an air-impervious bladder which is inflated by air to provide the desired resiliency thereto.

Still another objective of the invention is to provide such a support cushion which is usable in at least three positions, depending upon the position of the user's body, to provide the desired support, which positions are achieved by merely placing the cushion on a different one of its three main support surfaces.

Still another objective of the invention is to provide such a support cushion which, when placed in one of the three positions, has a flexing upper portion that is created by the geometry of the cushion, which creates a more natural curvature for the back, which allows the user's pelvis to rotate forward and the spine to curve back, whereby the spine assumes its natural position and minimizes any undue stress to the vertebrae and discs, and which does not restrict any of the pulmonary or circulatory functions of the user, and in which the flexing of the upper portion of the support cushion positions the weight of the body over the cushion rather than against it.

A further objective of the invention is to provide such a support cushion having a generally triangular shape with three contoured surfaces, each of which can be selectively placed on a supporting surface to provide the desired support for the user, depending upon whether the user is lying, sitting or at an in-between position.

Still another objective of the invention is to provide such a support cushion which is provided with a seat flap which helps anchor the cushion in position to prevent it from moving when seated upon by the user, especially when the cushion is formed of an inflatable bladder resulting in a lighter weight cushion than if the cushion is formed of a resilient foam material.

Another objective of the invention is to provide such a support cushion which can be formed relatively inexpensively, enabling it to be easily purchased for use by individuals, especially for use in the home environment.

These objectives and advantages are obtained by the improved multiple-position support cushion of the invention, the general nature of which may be stated as including a generally triangular-shaped resilient body having a pair of side surfaces and first, second and third support surfaces extending between said side surfaces and providing the triangular shape to said body; said first and second surfaces being substantially continuous and forming an acute angle therebetween, with said first surface joining said second surface at a first corner, and said third surface joining said first surface at a second corner and joining said second surface at a third corner; and said third surface having a stepped configuration formed by a pair of surface portions and an intermediate portion extending therebetween forming a convex corner.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
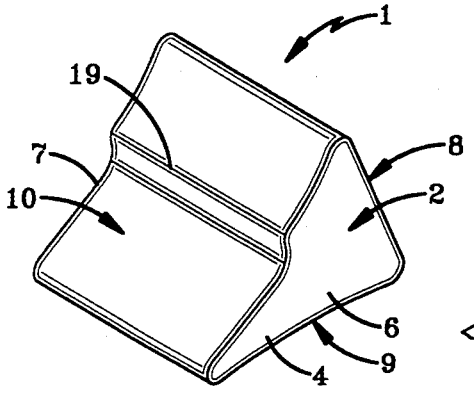
FIG. 1 is a perspective view of the support cushion of the invention, shown in a first position.
Figure 1A:
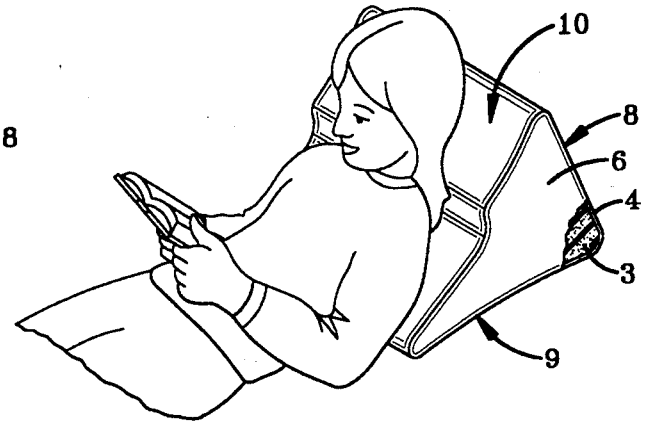
FIG. 1A is a diagrammatic perspective view with portions broken away, showing the manner of use of the support cushion when in the position of FIG. 1.

The multiple position support cushion of the present invention is indicated generally at 1, and a first embodiment thereof is shown specifically in FIGS. 1–6. Cushion 1 includes a generally triangular-shaped resilient body indicated generally at 2, which in the embodiment of FIGS. 1–6 is formed of a single block of a resilient foam material 3, preferably covered by a fabric or cloth 4 (FIG. 1A).

Figure 4:
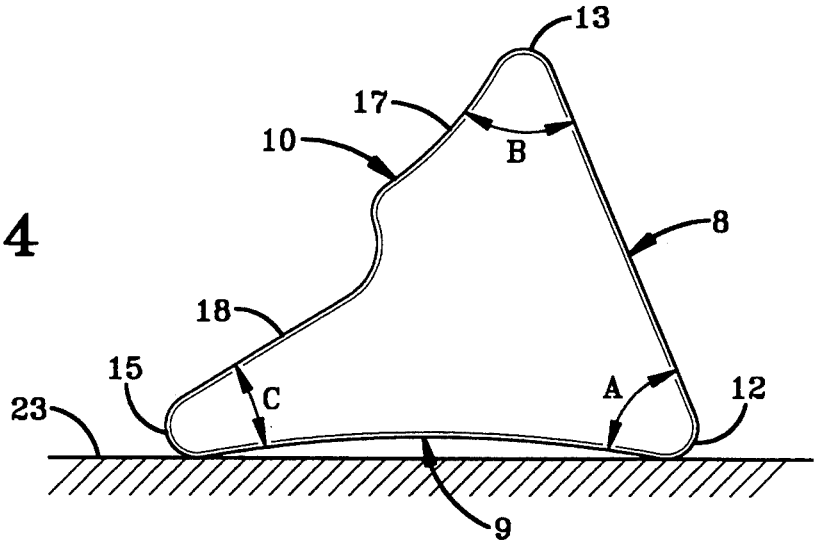
FIG. 4 is an enlarged side elevational view of the support cushion when in the position of FIG. 1.
Figure 5:
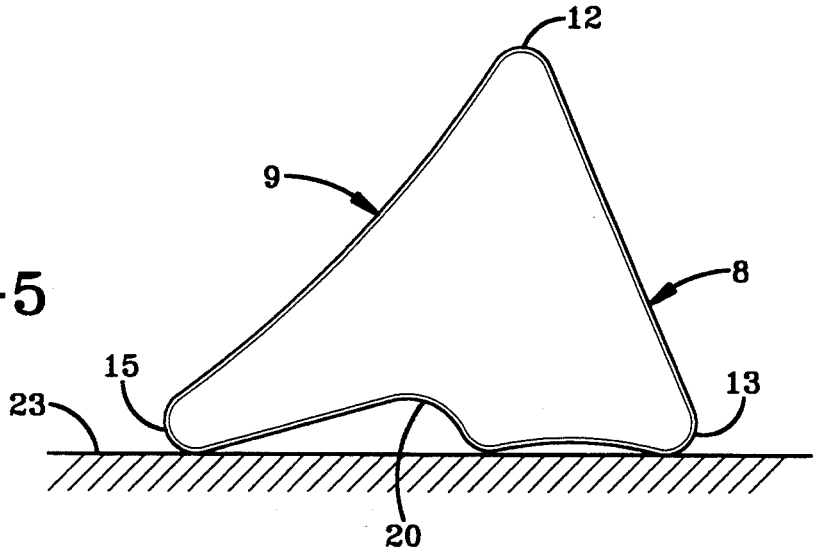
FIG. 5 is an enlarged side elevational view of the support cushion when in the position of FIG. 2.
Figure 6:
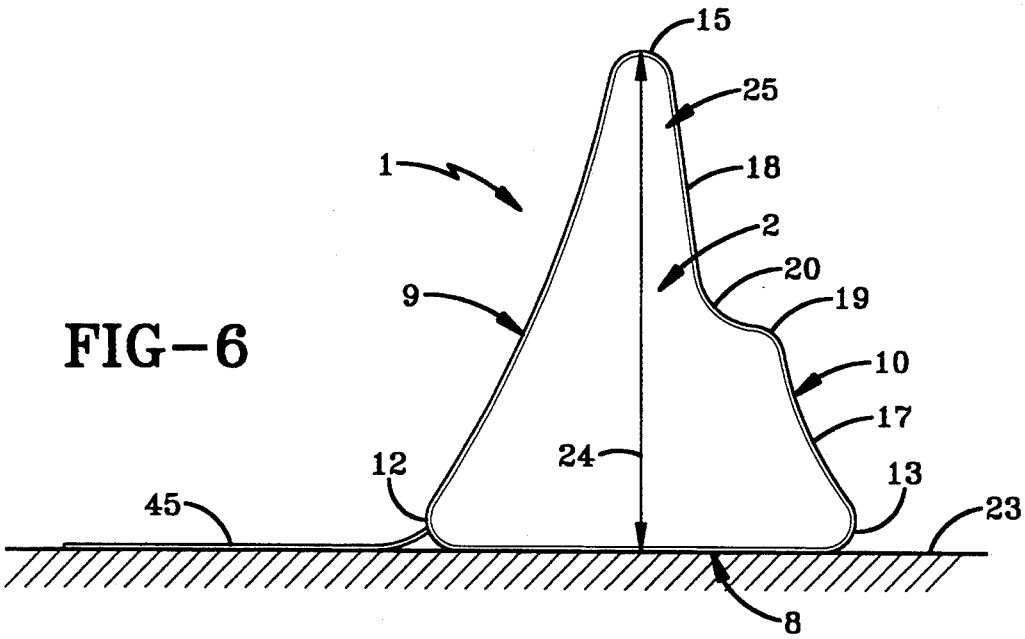
FIG. 6 is an enlarged side elevational view of the support cushion when in the position of FIG. 3.

Cushion 1 includes a pair of generally parallel triangular-shaped side surfaces 6 and 7, and first, second and third support surfaces, indicated generally at 8, 9 and 10, respectively. Referring to FIGS. 4–6, first support surface 8, preferably is generally flat, and merges with second and third surfaces 9 and 10 at generally rounded corners 12 and 13, respectively, and form substantially equal acute angles A and B therewith. Second surface 9 preferably has a generally continuous smooth concave configuration extending from corner 12 and terminating at a third corner 15 where it merges with third surface 10. Corner 15 also will have a generally rounded configuration. In the preferred embodiment, second support surface 9 will have a radius of curvature between 50 inches and 60 inches, with the preferred radius being approximately 54 inches. Surface 9 will also extend throughout an arcuate length of approximately 16°. However, if desired, surface 9 could be straight without affecting the concept of the invention or the results achieved by cushion 1.

In accordance with the invention, third surface 10 has a stepped configuration and includes first and second portions 17 and 18, respectively, which are connected together by an intermediate portion 20, and which forms a convex corner 19 with portion 17. First surface portion 17 preferably has a slightly concave configuration and extends throughout an arcuate length of approximately 19° and has a radius of curvature between 10 inches and 15 inches. Second portion 18 preferably has a generally flat planar configuration and extends throughout an arcuate length of approximately 9° and has a radius of curvature between 30 inches and 40 inches. Intermediate portion 20 is slightly concave when merging with portion 18. If desired, surface portions 17, 18 and 20 could all be generally planar and form generally sharper angles at their junctions, since the important feature is the formation of a stepped configuration wherein intermediate surface extends inwardly into the cushion body. Corner 19 and intermediate portion 20 preferably are located adjacent the midpoint of surface 10.

In the preferred embodiment, when first support surface 8 rests on a support surface which is indicated at 23 (FIGS. 3 and 6), third corner 15 is generally vertically aligned with the midpoint of surface 8, and will have a vertical height, indicated at 24, of approximately 16 inches. In accordance with another of the features of the invention, best shown in FIGS. 3, 3A and 6, upper portions of the second and third surfaces 9 and 10 adjacent corner 15, form a flexible generally triangular-shaped upper portion 25, the functions of which are described in further detail below.

A second embodiment of the invention is shown particularly in FIGS. 7–10 and is indicated generally at 30. Cushion 30 is similar in nearly all respects to cushion 1 described above except that it is formed of an air-impervious bladder material, such as plastic or rubber. This cushion includes at least one valve 31 for admitting air into a hollow interior 29 thereof for inflating the cushion into the triangular shape described previously. Cushion 30 includes generally parallel side surfaces 32 and 33, and first, second and third support surfaces 34, 35 and 36, respectively, which are similar to support surfaces 8, 9 and 10 described previously, and which meet to form first, second and third corners 42, 43 and 44, respectively.

Figure 8:
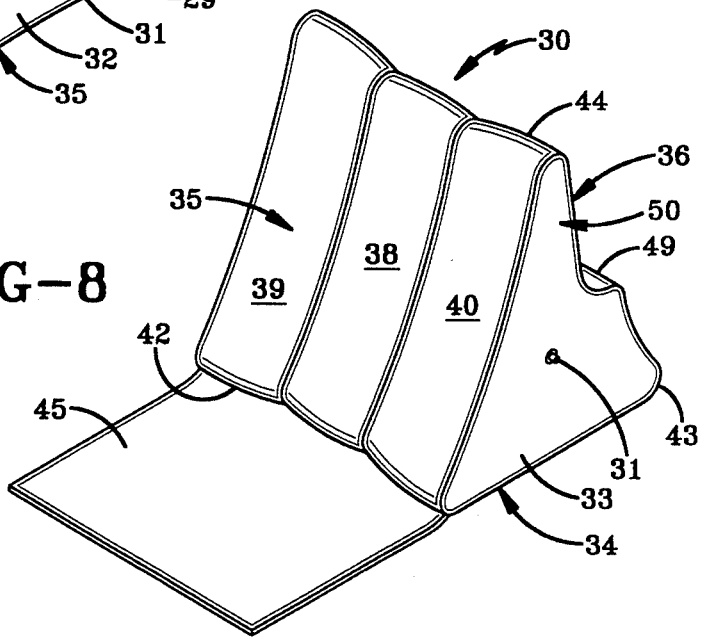
FIG. 8 is a rear perspective view of the modified support cushion of FIG. 7 having an anchoring flap attached thereto.
Figure 9:
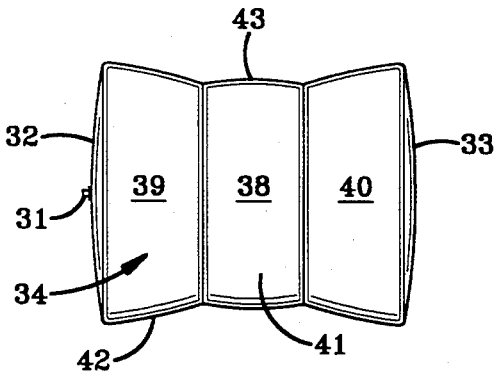
FIG. 9 is a rear elevational view of the support cushion of FIG. 7 looking in the direction of arrows 9—9, FIG. 7.
Figure 10:
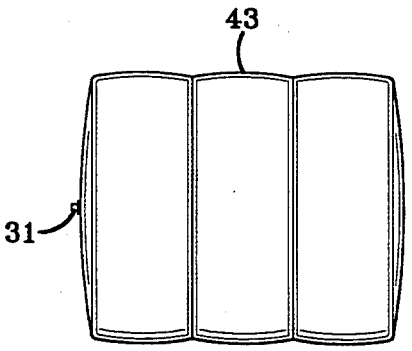
FIG. 10 is a rear elevational view similar to FIG. 9 of a further embodiment of the support cushion shown in FIGS. 7–9.

One of the features of cushion 30 is shown in FIGS. 8 and 9, in which an intermediate portion 38 is slightly smaller than adjacent portions 39 and 40 so as to form a generally concave configuration to back support surface 34 and a concave configuration to second corner 43, which is similar to second corner 13 of cushion 1. FIG. 10 shows a slightly modified form of cushion 30, wherein the first and second corners are generally straight as opposed to having the concave configuration shown in FIG. 9.

FIGS. 3, 3A, 6 and 8 show another modification to the improved support cushion, wherein a flexible flap 45 is attached to the cushion body generally adjacent corners 12 and 42. Flap 45 will extend outwardly from the cushion, and will be seated upon by a user when first support surfaces 8 and 34 rest against the ground or surface to assist in maintaining the cushion in its position by preventing it from sliding across the ground or support surface.

When the cushion is used in the position as shown in FIGS. 1, 1A, 4 and 7, wherein second surfaces 9 and 35 rest on surface 23, contoured surfaces 10 and 36 accommodate the shoulders, neck and head in a more appropriate position for reading, viewing television, etc. The user preferably is in the supine position, with surface portions 17 and 47 supporting the user's head, with second portions 18 and 48 supporting the user's shoulders. The intervening corners 19 and 49 are shaped to accommodate the back of the neck during the transition from the shoulders to the back of the head, as shown in FIG. 1A. This produces the proper position for supporting the head and shoulders while viewing television or reading in a supine position.

Figure 2:
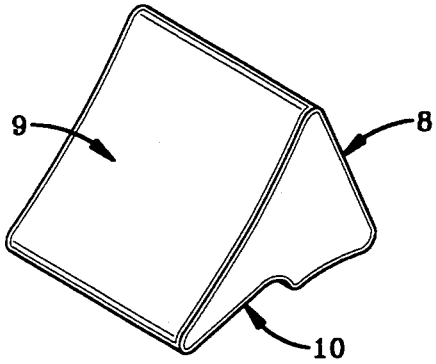
FIG. 2 is a perspective view of the support cushion shown in a second position.
Figure 2A:
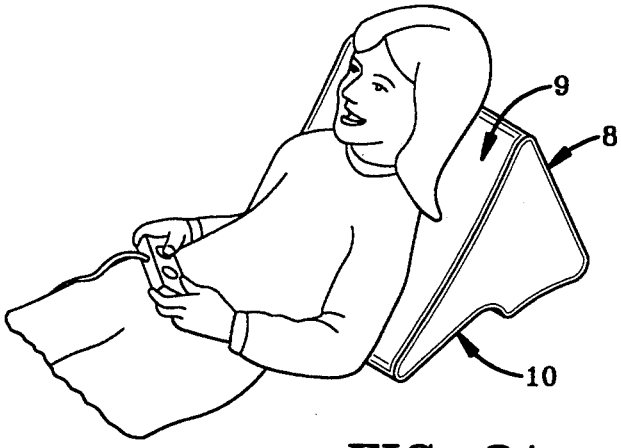
FIG. 2A is a diagrammatic perspective view showing the manner of use of the support cushion when in the position of FIG. 2.

When used in the position as shown in FIGS. 2A and 5, wherein the third contoured support surface 10 rests upon surface 23, the cushion and in particular, second surface 9, provides an intermediate level of support for the upper body in an elevated position and represents an intermediate position for both supine and prone relaxing and reading positions.

FIGS. 3, 3A, 6 and 8 show the cushion in a position in which the full continuous first surfaces 8 and 34 support the back and upper body in a sitting position. As regards to this position, when sitting on the floor or ground, most people assume a position with their legs crossed and their elbows resting on their knees in order to assists in supporting their upper body, as described in the Background Information portion, which positions the curvature of the spine into a condition called "kyphosis". This may result in damage to the discs over time, and results in restricted pulmonary and circulatory functions as well. However, when support cushions 1 and 30 are in this position, the flexing action of upper portions 25 and 50 position the weight of the body over the cushion rather than against it.

Figure 7:
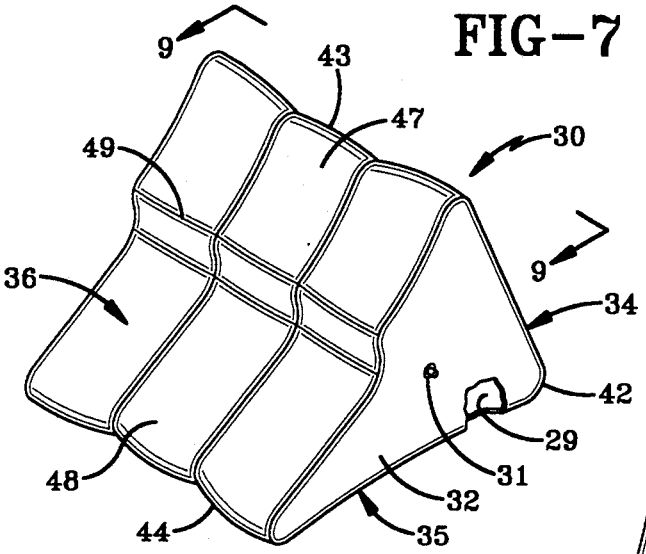
FIG. 7 is a perspective view with portions broken away, of a second embodiment of the support cushion as shown in the position of FIG. 1.

In summary, the multiple position support cushions 1 and 30 are one-piece resilient cushions that may be easily positioned to provide support for the head and body in either sitting or lying positions. The fully upholstered, triangular-shaped foam cushion or inflatable cushion may be used in any of three positions to create a lying, sitting and in-between resting position. FIGS. 1A and 7 represent the position the cushion is in when the user is in the supine position. The cushion supports the head on its upper surface while contouring to the shoulders on the lower surface. The convex corner is shaped to accommodate the back of the neck during the transition from the shoulders to the back of the head. This produces the proper position for supporting the head and shoulders when viewing or reading while in a supine position.

Figure 3:
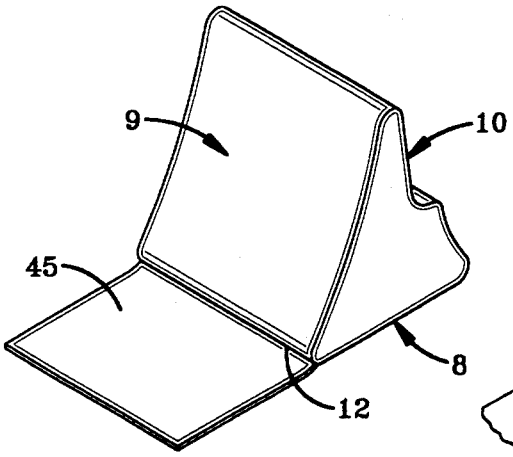
FIG. 3 is a perspective view of a modified embodiment of the support cushion of FIGS. 1 and 2, shown in a third position.
Figure 3A:
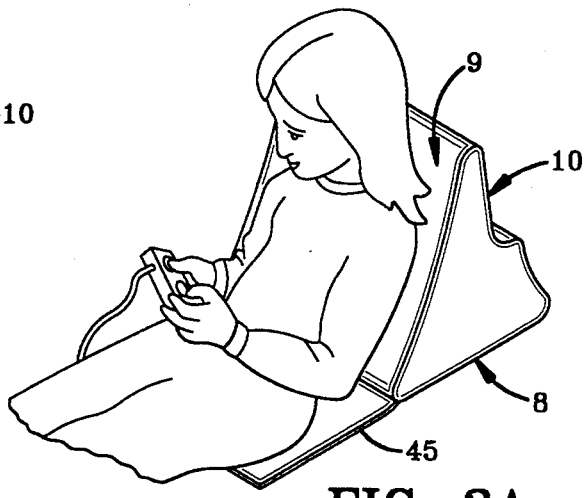
FIG. 3A is a diagrammatic perspective view showing the manner of use of the support cushion when in the position of FIG. 3.

FIG. 2 represents the intermediate position for both supine and prone relaxing and reading. When the support cushion is positioned as shown in FIGS. 3A and 8, the user's back is positioned against the large, preferably curved, surfaces 9 and 35 for support in a seated position. As discussed above, the cushion's unique shape provides the flexing action at the upper triangular portion to accommodate the shoulder, neck and head thereon, while the large, preferably curved, surface supports the back while the user is seated on the supporting surface and/or the anchoring flap. As a result, when the cushion is being used to support the back as shown in FIG. 3A and 8, the opposing contours work in combination to create a flexing or bending of the cushion in the lower surface portion. This creates a more natural curvature for the back, while allowing the user's pelvis to rotate forward and the spine to curve back, resulting in a condition of "lordosis", which allows the curvature of the spine to assume its natural position and minimize any undue stress to the vertebrae and discs, or restrict any of the pulmonary or circulatory functions. Additionally, the flexing of the upper triangular portion now positions the weight of the body over the cushion, rather than against it. This load or downward force reduces the likelihood of the cushion slipping away from the user if used without a flap, which is more likely to happen with a purely triangular-shaped cushion.

Furthermore, as indicated previously, although second surfaces 9 and 35 are preferably formed with a slight concave curvature, they may be flat, generally similar to first surfaces 8 and 34. Likewise, the stepped configuration of surfaces 10 and 36 may be formed by two planar surfaces 17 and 18, and a generally planar intermediate surface 19, instead of the particular curved configuration shown particularly in FIG. 6. The critical portion is the formation of an intermediate, generally convex corner which extends across the width of the cushion formed by the stepped configuration of generally equal length portions 17 and 18, and portions 47 and 48.

Likewise, as indicated previously, the acute angles A and B formed at the first and second corners 12 and 13, respectively, are generally equal to each other and will always be greater than the included angle formed between second and third surfaces 9 and 10 at corner 15.

Likewise, when cushion 1 is in the position of FIG. 5, intermediate portion 20 provides for a flexing or cushioning effect to the cushion when the user's back extends along surface 9.

Inflatable cushion 30 reduces shipping and production costs from those of cushion 1.

Accordingly, the support cushion of the present invention is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved support cushion is constructed and used, the characteristics of the construction, and the advantageous, new and useful results obtained; the new and useful structures, devices, elements, arrangements, parts and combinations, are set forth in the appended claims.

I claim:

1. A multiple position support cushion including:

a generally triangular-shaped resilient body having a pair of side surfaces and first, second and third support surfaces extending between said side surfaces and providing the triangular shape to said body;

said first and second surfaces being substantially continuous and forming an acute angle therebetween, with said first surface joining said second surface at a first corner, and said third surface joining said first surface at a second corner and forming an acute angle therebetween, and joining said second surface at a third corner; and said third surface having a stepped configuration formed by first and second surface portions and an inwardly extending intermediate portion extending therebetween forming an intermediate corner wherein said first portion of the third surface extends between the second corner and the intermediate corner; the intermediate portion is generally concave; and said second portion is substantially flat and is inclined between said intermediate portion and the third corner.

2. The cushion defined in claim 1 in which the body is formed of a foam material.

3. The cushion defined in claim 1 in which the foam material is covered with a fabric.

4. The cushion defined in claim 1 in which the body is formed of an air impervious material and provides an internal compartment; and in which a valve is provided for filling said compartment with air.

5. The cushion defined in claim 4 in which the body has three portions; and in which the sizes of said three portions vary to provide a concave configuration extending between the side surfaces.

6. The cushion defined in claim 1 in which the three corners are rounded.

7. The cushion defined in claim 1 in which the second surface has a continuously smooth concave configuration with an arcuate length of approximately 16°.

8. The cushion defined in claim 1 in which the second surface has a radius of curvature between 50 inches and 60 inches.

9. The cushion defined in claim 8 in which the second surface has a radius of curvature of substantially 54 inches.

10. The cushion defined in claim 1 in which the acute angles formed at the corners between the first surface and the second surface, and between the first surface and the third surface are substantially equal.

11. The cushion defined in claim 10 in which an included angle is formed at the third corner between the second and third surfaces; and in which said angle is less than each of the acute angles at the first and second corners.

12. The cushion defined in claim 1 in which the third corner is located vertically above and is in substantial alignment with the midpoint of the first surface when said first surface supports the cushion on a supporting surface.

13. The cushion defined in claim 12 in which the third corner is substantially 16 inches above said first surface.

14. The cushion defined in claim 12 in which portions of the second and third surfaces and side surfaces adjacent the third corner form a flexible generally triangular-shaped upper portion when the first surface supports the cushion on a supporting surface.

15. The cushion defined in claim 1 in which a flexible flap is attached to the body adjacent the first corner and is adapted to extend along a support surface when the first surface of the body rests upon the support surface.

16. The cushion defined in claim 1 in which the side surfaces are generally planar and are parallel to each other.

* * * * *